US007341211B2

(12) United States Patent
Ganan Calvo et al.

(10) Patent No.: US 7,341,211 B2
(45) Date of Patent: Mar. 11, 2008

(54) DEVICE FOR THE PRODUCTION OF CAPILLARY JETS AND MICRO-AND NANOMETRIC PARTICLES

(75) Inventors: Alfonso M. Ganan Calvo, Sevilla (ES); Jose M. Lopez-Herrera Sanchez, Sevilla (ES)

(73) Assignee: Universidad De Sevilla, Sevilla (ES)

( * ) Notice: Subject to any disclaimer, the term of this patent is extended or adjusted under 35 U.S.C. 154(b) by 86 days.

(21) Appl. No.: 10/503,509

(22) PCT Filed: Feb. 4, 2003

(86) PCT No.: PCT/ES03/00065

§ 371 (c)(1),
(2), (4) Date: Jan. 21, 2005

(87) PCT Pub. No.: WO03/066231

PCT Pub. Date: Aug. 14, 2003

(65) Prior Publication Data

US 2005/0116070 A1 Jun. 2, 2005

(30) Foreign Application Priority Data

Feb. 4, 2002 (ES) ..... 200200285
Feb. 3, 2003 (ES) ..... 200300276

(51) Int. Cl.
*B05B 5/00* (2006.01)

(52) U.S. Cl. ..... 239/690; 239/86; 239/371; 239/419; 239/424; 239/450; 239/695; 239/696; 239/706

(58) Field of Classification Search ..... 239/86, 239/449, 450, 690, 695, 696, 706, 707, 708, 239/371, 419, 424, 557, 558, 416.3, 416.4, 239/416.5

See application file for complete search history.

(56) References Cited

U.S. PATENT DOCUMENTS 4,508,265 A * 4/1985 Jido ..... 239/3

(Continued)

FOREIGN PATENT DOCUMENTS

CH 563807 7/1975

(Continued)

OTHER PUBLICATIONS

International Search Report dated Jun. 2, 2003 for PCT/ES03/00065.

*Primary Examiner*—Kevin Shaver
*Assistant Examiner*—Jason Boeckmann
(74) *Attorney, Agent, or Firm*—Arent Fox LLP

(57) ABSTRACT

The invention relates to a method and devices for the production of capillary microjets and microparticles that can have a size of between hundreds of micrometers and several nanometers. The inventive method makes use of the combined effects of electrohydrodynamic forces, fluid-dynamic forces and a specific geometry in order to produce micro- and nano-capsules or fluid jets, single- or multi-component, which, upon disintegrating or splitting, form a significantly monodispersed spray of drops which have a controlled micro- or nanometric size and which can also comprise a specific internal structure, such as, for example, a nucleus which is surrounded by a cortex of a different substance or several concentric or non-concentric nuclei or vesicles which are surrounded by a cortex.

12 Claims, 6 Drawing Sheets

U.S. PATENT DOCUMENTS 4,962,885 A * 10/1990 Coffee ..... 239/3
6,086,740 A * 7/2000 Kennedy ..... 204/601
6,119,953 A * 9/2000 Ganan-Calvo et al. ..... 239/8
6,405,936 B1 * 6/2002 Ganan-Calvo ..... 239/8
6,481,648 B1 * 11/2002 Zimmermann ..... 239/690
6,679,441 B1 1/2004 Borra et al.

FOREIGN PATENT DOCUMENTS

FR 2 776 538 10/1999

* cited by examiner

DEVICE FOR THE PRODUCTION OF CAPILLARY JETS AND MICRO-AND NANOMETRIC PARTICLES

FIELD OF THE INVENTION

The invention describes a method and device for the production of capillary micro-jets and micro-particles, with a size ranging from some hundred microns to some nanometers. The method is based on the combined effect of electro-hydrodynamic forces, fluido-dynamic forces, and a specific geometry, to give rise to micro- and nano- fluid ligaments or jets; as these disintegrate or break up, a controllable and relatively monodisperse spray is formed, with drops in the micro- or nanometric range; in addition, the spray may display specific internal structure features, such as a nucleus surrounded by a heterogeneous shell, or a plurality of nuclei or vesiculae, which may be concentrical or not, surrounded by a shell.

BACKGROUND OF THE INVENTION

The electro-hydrodynamic atomization of liquids, or electrospray, has provided an essential tool for the biochemical analysis over the last decades (Electrospray Mass Spectrometry, o ESMS), following the discovery of its potential in the middle 80s. One of the advantages it presents is the small amount of analyte required for the analysis. Nevertheless, in the case of applications requiring the atomization or breakup of a sufficiently large amount of liquids per unit of time, a key limitation of electrospray is its low productivity. Some examples of these applications are to be found in the pharmaceutical industry (active principle encapsulation), food industry (encapsulation of diverse organoleptic ingredients among other), phytosanitary industry . . . In particular, some electrospray applications have arise aiming at the generation of composite jets, with concentrical arrays of diverse immiscible or hardly miscible liquids (Loscertales, Cortijo, Barrero and Gañán 2001, patent request PCT/ES02/00047); such applications are geared to the production of micro-capsules or nano-capsules; however, research is challenged by the need to increase the productivity of the electrospray technology and devices.

On the other hand, the atomization of liquids by purely fluidomechanic means, in particular by pneumatic procedures, is a capital tool in many applications and industrial, technological or scientific developments, having an impact on our daily life. The so-called "Flow Focusing" technology (Gañán-Calvo 1998, *Physical Review Letters* 80, 285), is based on specific flow geometries and takes the pneumatic option to generate liquid micro-jets which break up into very small drops of essentially homogeneous size. "Flow focusing" is also able to produce liquid micro-jets surrounded by another liquid—rather than by a gas—; alternatively it can produce gas micro-jets surrounded by a liquid, which may play the role of a focusing agent, analogous to the role of the gas in a standard pneumatic device; as a result, microbubbles of perfectly homogeneous size are produced.

There are many liquids which cannot be atomized as a result of their physical properties; sometimes, they cannot be combined to the end of forming micro-drops or capsules by electro-hydrodynamic atomization.

The flow-focusing technology, in turn, is limited in that it may require very large atomization pressure when nanometric sizes are sought. This may prove a handicap in some applications.

Both these disadvantages are overcome by means of the invention disclosed in the Spanish patent request P2002-00286. The invention deals with a non-trivial combination of the electrospray and flow focusing technologies. The result is a procedure allowing the manipulation of a wide parametric spectrum involving diverse liquid properties, liquid flow-rates and drop sizes including combinations that cannot be handled or are hard to handle with any of the two mentioned technologies taken separately: i.e. a low reproducibility or robustness would be observed.

SUMMARY OF THE INVENTION

The present invention aims at increasing substantially the productivity of electrospray. It is based on the simultaneous effect of two principles:

(i) The use of a large number of injection needles or capillary tubes, with a special electrode geometry.

(ii) The micro-jet and the spray are produced by an electric process and then are efficiently sucked away by flow-focusing effect. A much smaller charge density is produced in the vicinity of the tip of the conical capillary meniscus from which the micro-jet is issued. As a result, the jet is stabilized and flows steadily with a high flow-rate; such conditions are unattainable in the absence of a flow-focusing suction.

For the device to work, the electric field at the extreme or tip of the injection tubes must be above a threshold which is a function of the surface tension of the liquid which is to be atomized. Were the needle to be isolated, a flat electrode facing the needle would be enough to reach the critical electric field threshold. However, when a large number of needles are brought together and their relative distance diminishes, the electric field at their tips also decreases accordingly; this sets a limit on the packaging density of the needles in the design. The present invention provides a new approach to the electrode design allowing a high packaging density; in addition, a solution is disclosed allowing the combination of electrostatic forces acting on the liquid with mechanical forces extracting the spray through the electrode.

The invention combines three key aspects:

(i) In order to produce a steady capillary micro-jet in the laminar regime issuing from the tip of the liquid-feeding tube, fluidic forces are used in conjunction with external electric forces (optional): the absence of any of these forces (fluidic or electrical) will lead to a radical modification in the properties of the resulting capillary micro-jet or the resulting particles; in some cases, its production becomes impossible when only fluidic or electro-hydrodynamic forces are used. The abovementioned electric forces are produced at the liquid surface once it leaves the feed tube; these forces are caused by a potential difference established between an electrode of specific shape, facing the tube, and the tube itself. The forces of a fluidic nature, in turn, are produced at the same liquid surface when a second fluid, to be referred to as "focusing fluid", immiscible with the liquid (for instance, a gas), is forced to flow around the capillary liquid feed tube towards an orifice located in the electrode facing the outlet of the feed tube. Such fluidic force is used in the flow-focusing technology (Gañán-Calvo 1998,*Physical Review Letters* 80, 285) in order to give rise to steady liquid micro-jets.

(ii) The geometry of the electrode facing the feed tube is such that it is located in front of it (FIGS. 1 and 2) without contacting it; it has an outlet in line with the orifice of the feed tube; the distance between the orifice of the feed tube and the outlet of the electrode is small compared with the distance of the feed tube to other feed tubes in the vicinity. The geometry is meant to avoid electric screening of each feed tube by the action of neighbour feed tubes.

(iii) The external surface of the feed tube can be treated in an adequate manner, e.g. by means of a hydrophobe, so that the liquid injected through this feed tube does not spill or migrate by capillary action along said external surface; this surface treatment constrains the liquid to the outlet of the feed tube, needle or capillary. This feature is not essential, because in many cases, the sweeping effect caused by the focusing fluid keeps the liquid anchored to the outlet of the feed tube in the form of a capillary cone, cusp-shaped, from whose tip the fluid micro-jet or micro-ligament issues.

The three features above combine to define the invention. The object of the present invention is therefore a special combination following the claims of the previous technological modes known as electrospray and "flow focusing"; the combination is non-trivial and involves a specific geometry. This non-trivial combination allows to expand the parametrical range of the fluid properties and the fluid flow-rates, including combinations that cannot be reached with Electrospray or Flow-Focusing taken separately: i.e. it would not be possible to produce steady fluid jet-emissions for some given fluids and under particular setups, while the combination in the present invention would be successful. Another object of this invention is the device and the proposed geometry as disclosed (FIG. 1 to 5) in order to carry out said technological combination, which is the core of the invention.

Thus, an object of the invention is a device for the production of steady capillary jets and liquid drops of micrometric or nanometric size characterized by:

a) a number N of capillary tubes, wherein each capillary tube transports a flow-rate $Q_i$ of a given fluid i, and i is an integer from 1 to N; each of said capillary tubes is located so that the (i−1)-fluid surrounds the i-capillary tube; each one of the capillary tubes or each fluid in the capillary tubes is connected to an electric potential $V_i$ with respect to a ground electrode; each one of the fluids transported by said capillary tubes is immiscible or poorly miscible with the adjacent fluids;

b) an electrode, connected to an electric potential $V_0$, facing the outlet of the most prominent capillary tube; said electrode includes an orifice whose minimal transversal dimension is $D_0$ ranging from $10^{-6}$ to $10^2$ times, preferably $10^{-3}$ to 10 times, the minimal transversal dimension $D_1$ of the outlet section of the outermost capillary tube; said orifice is located facing the outlet of the most bulging capillary tube, at a distance ranging from 0.005 to 5 times $D_1$; said electrode is shaped in such a way that each point of its inner surface or each point of its surface oriented to said capillary tubes stands at a distance from the outer surface of the outermost capillary tube which is greater than the minimal distance from the orifice of said electrode to the most bulging outlet of all capillary tubes.

Yet another object of the invention is a device for the production of steady capillary jets and liquid drops of micrometric or nanometric size according to the above paragraph, characterized in that both the electrode orifice and the outlet sections of all capillary tubes are defined by a surface limited by a closed line of arbitrary geometry, preferably a circular shape, regular or irregular polygonal shape, or ellipsoidal shape.

An object of the present invention is also a device for the production of steady capillary jets and liquid drops of micrometric or nanometric size following the above, characterized in that both the electrode orifice and the outlet sections of all capillary tubes are defined by a surface limited by two closed curves of arbitrary geometry, such that the minimal distance between the two curves is smaller than 0.1 times the total length of the longest curve.

Yet another object of the invention is a device for the production of steady capillary jets and liquid drops of micrometric or nanometric size following the above, characterized in that the potential difference $\Delta V$ between the potential of the outermost capillary tube or the outermost fluid ($V_1$) and the potential of the electrode $V_0$ is larger than 0.1 times the greater of the two values $(\gamma.D_0/\epsilon_0)^{0.5}$ and $(\gamma.D_1/\epsilon_0$where $\epsilon$ is the interfacial surface tension between the fluid flowing through the interior of the outermost capillary tube and the fluid or the void located in the space between the outer wall of the outermost capillary and the inner wall of the electrode, and $\epsilon_0$ is the permittivity of the fluid or the void located in the space between the outer wall of the outermost capillary and the inner wall of the electrode.

In addition, an object of the present invention is a device for the production of steady capillary jets and liquid drops of micrometric or nanometric size following the above, characterized in that the number of capillary tubes is N=1 and the minimal transversal dimension of the electrode orifice $D_0$ ranges between $10^{-2}$ and 5 times the minimal transversal dimension $D_1$ of the outlet section of the outermost capillary tube, the outlet orifice of the electrode is located facing the outlet of the capillary tube at a distance ranging between 0.05 and 2 times $D_1$, and each point of the inner surface of the electrode stands at a distance from the outer surface of the capillary tube ranging from 1 to 10 times the minimal distance from the orifice of said electrode to the outlet of the capillary tube, while the external rim of the electrode is located at a distance of 1 to 100 times $D_1$ from said orifice.

Yet another object of this invention is a device for the production of steady capillary jets and liquid drops of micrometric or nanometric size following claims the above, characterized in that $D_1$ ranges from 0.5 micrometers and 5 milimeters, preferably from 10 micrometers and 1 milimeter; and also characterized in that the outer surface ot at least one of the capillary tubes is covered by a hydrophobe substance, so that it stops or limits the wetting of said surface by the fluid flowing through the interior of said capillary tube.

Yet another object of this invention is a multi-device for the production of steady capillary jets and liquid drops of micrometric or nanometric size characterized in that it is made up of at least three devices following the above description, assembled in the vicinity of each other, and with relative angles ranging from −89 to 89 sexagesimal degrees, preferably −10 to 10 sexagesimal degrees, all of said devices pointing in the same direction, so that the axes of the capillary tubes form a minimal angle from 5 to 90 sexagesimal degrees, preferably 70 to 90 sexagesimal degrees, relative to the plane or virtual surface where the orifices of said electrodes are located.

In addition, an object of this invention is a procedure for the production of steady capillary jets and liquid drops of micrometric or nanometric size by means of a device as disclosed in the above paragraphs characterized by the following steps:

a) forcing N fluids to flow, with flow-rates $Q_i$, i being an integer from 1 to N, through N capillary tubes, wherein each of said capillary tubes is located so that the (i−1)-fluid surrounds the i-capillary tube; each one of the capillary tubes or each fluid in the capillary tubes is connected to an electric potential $V_i$ with respect to a ground electrode; each one of the fluids transported by said capillary tubes is immiscible or poorly miscible with the adjacent fluids;

b) connecting an electrode, located facing the outlet of the most prominent of the N capillary tubes at an electric potential $V_0$, in such a way that the potential difference $\Delta V$ between the potential of the outermost capillary tube or the outermost fluid ($V_1$) and the potential of the electrode $V_0$ is larger than 0.1 times the greater of the two values $(\gamma.D^0/\epsilon_0)^{0.5}$ and $(\gamma.D_1/\epsilon_0)^{0.5}$, where $\gamma$ is the interfacial surface tension between the fluid flowing through the interior of the outermost capillary tube and the fluid or the void located in the space between the outer wall of the outermost capillary and the inner wall of the electrode, and $\epsilon_0$ is the permittivity of the fluid or the void located in the space between the outer wall of the outermost capillary and the inner wall of the electrode.

Yet another object of the invention is a procedure for the production of steady capillary jets and liquid drops of micrometric or nanometric size by means of a device following the above characterized in that along with with connecting the outermost fluid or capillary tube at a potential $V_1$ and connecting the electrode at a potential $V_0$, a surrounding fluid is forced to flow between the outer surface of the electrode and the inner surface of the outermost capillary tube towards the outlet orifice of the electrode, said surrounding fluid being immiscible with the fluid forced through the outermost capillary tube, the flow-rate of said surrounding fluid being $Q_0$, where $Q_0$ is larger than 0.1 times the greater value of $D_0^2[\gamma/(D_0.\rho_0)]^{0.5}$ and $[\gamma/(D_1.\rho_0)]^{0.5}$, where $\rho_0$ is the density of said surrounding fluid, and $\gamma$ is the interfacial surface tension between the fluid flowing through the interior of the outermost capillary tube and the fluid or the void located in the space between the outer wall of the outermost capillary and the inner wall of the electrode.

Yet another object of the present invention is a procedure for the production of bubbles of micrometric or nanometric size by means of a device as disclosed above characterized by the following steps:

a) forcing N fluids to flow, with flow-rates $Q_i$, i being an integer from 1 to N, through N capillary tubes, wherein each of said capillary tubes is located so that the (i−1)-fluid surrounds the i-capillary tube; each one of the capillary tubes or each fluid in the capillary tubes is connected to an electric potential $V_i$ with respect to a ground electrode; each one of the fluids transported by said capillary tubes is immiscible or poorly miscible with the adjacent fluids;

b) connecting an electrode, located facing the outlet of the most prominent of the N capillary tubes at an electric potential $V_0$, in such a way that the potential difference $\Delta V$ between the potential of the outermost capillary tube or the outermost fluid ($V_1$) and the potential of the electrode $V_0$ is larger than 0.1 times the greater of the two values $(\gamma.D^0/\epsilon_0)^{0.5}$ and $(\gamma.D_1/\epsilon_0)^{0.5}$, where $\gamma$ is the interfacial surface tension between the fluid flowing through the interior of the outermost capillary tube and the fluid or the void located in the space between the outer wall of the outermost capillary and the inner wall of the electrode, and $\epsilon_0$ is the permittivity of the fluid or the void located in the space between the outer wall of the outermost capillary and the inner wall of the electrode;

characterized in that the fluid forced through the innermost capillary tube is a gas.

Finally, an object of the present invention is a procedure for the production of bubbles of micrometric or nanometric size following the above, characterized in that along with connecting the outermost fluid or capillary tube at a potential $V_1$ and connecting the electrode at a potential $V_0$, a surrounding fluid is forced to flow between the outer surface of the electrode and the inner surface of the outermost capillary tube towards the outlet orifice of the electrode, said surrounding fluid being immiscible with the fluid forced through the outermost capillary tube, the flow-rate of said surrounding fluid being $Q_0$, where $Q_0$ is larger than 0.1 times the greater value of $D_0^2[\gamma/(D_0.\rho_0)]^{0.5}$ and $D_1^2[\gamma/(D_1.\rho_0)]^{0.5}$, where $\rho$is the density of said surrounding fluid, and $\gamma$ is the interfacial surface tension between the fluid flowing through the interior of the outermost capillary tube and the fluid or the void located in the space between the outer wall of the outermost capillary and the inner wall of the electrode.

A substantial advantage of the method here proposed with respect to the state-of-the-art is that much larger liquid flow-rates can be used (up to several hundred times larger) in each capillary tube with stable regime; such flow-rates would give rise to instability in the absence of a suction or flow-focusing effect.

Other advantage of the invention relative to the state-of-the-art is that the drops originating from the micro-jet's breakup are automatically unelectrified as they move near the edges of the orifice.

Other advantage of the invention relative to the state-of-the-art is that, since the capillary feed tube is located significantly close to the outlet orifice of the electrode, electric effects are restricted to the area next to said orifice and feed tube; and the electrostatic effect of nearby feed tubes is damped.

Other advantage of the invention relative to the state-of-the-art is that, provided the electrode has as heath-geometry, the electrode will guide the flow of the external fluid, thus increasing drag effects on the external surface of the outermost feed tube and leading to an increase in the suction or drag effect on the fluids to be atomized through said orifice.

Other advantage of the invention relative to the state-of-the-art is that, provided the electrode has a sheath-geometry, said electrode will have an increased mechanical stiffness, being more resilient—owing to its shape—against deformations caused by the pressure of the outermost fluid.

EMBODIMENT OF THE INVENTION

In what follows, an embodiment example is described for the present invention; it does not attempt to be exhaustive nor to limit the scope of the present invention; it is only disclosed as an illustration, while the actual protection field of the invention is to be construed from the claims.

Figure 1:
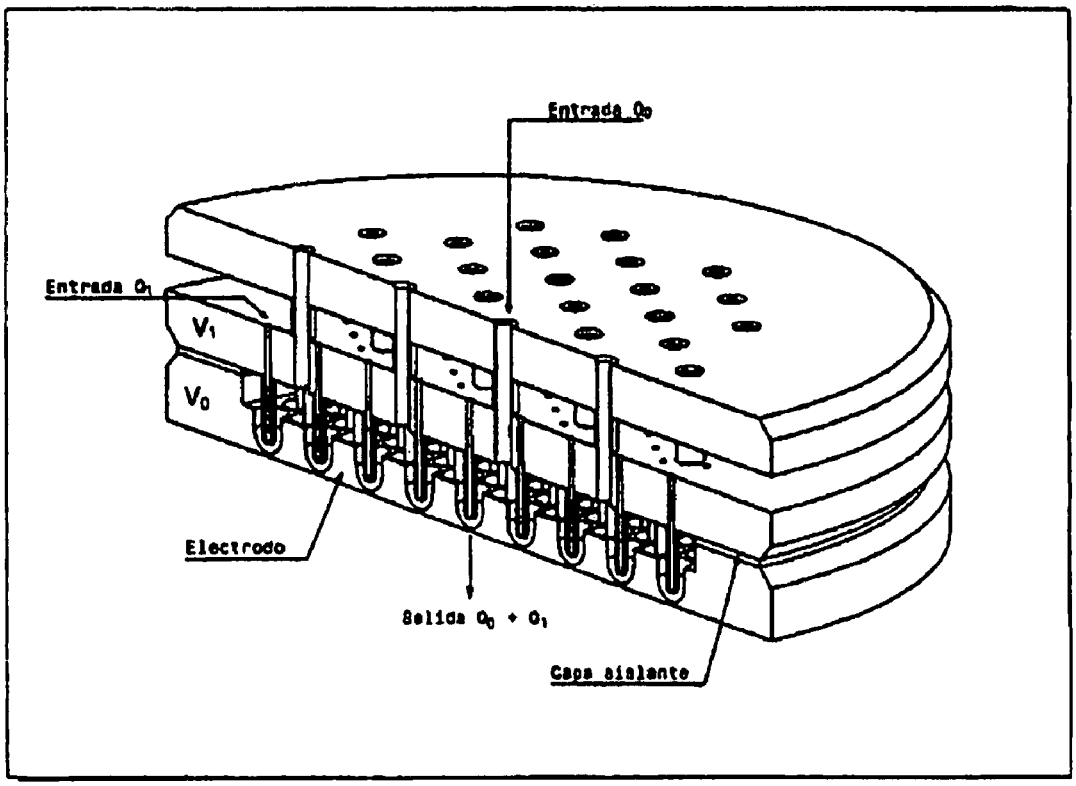
FIG. 1. Example of an embodiment of the device according to the invention, in the case where N=1, where the feed tubes are shown, as well as the multiple electrode ("Electrode", 55 cells in this particular case) with its specific geometry, and the means used to supply a second fluid through the upper orifices of the upper element. Characteristic routes followed by the fluid being forced through the feed tubes are shown in yellow ($Q_1$) while the routes of the surrounding fluid being forced through the device are shown in red ($Q_0$) (this fluid is immiscible with the fluid being injected through the capillary tubes). Also shown are the electric potentials $V_1$ and $V_2$ in each element and the isolating layer between both elements.
Figure 2:
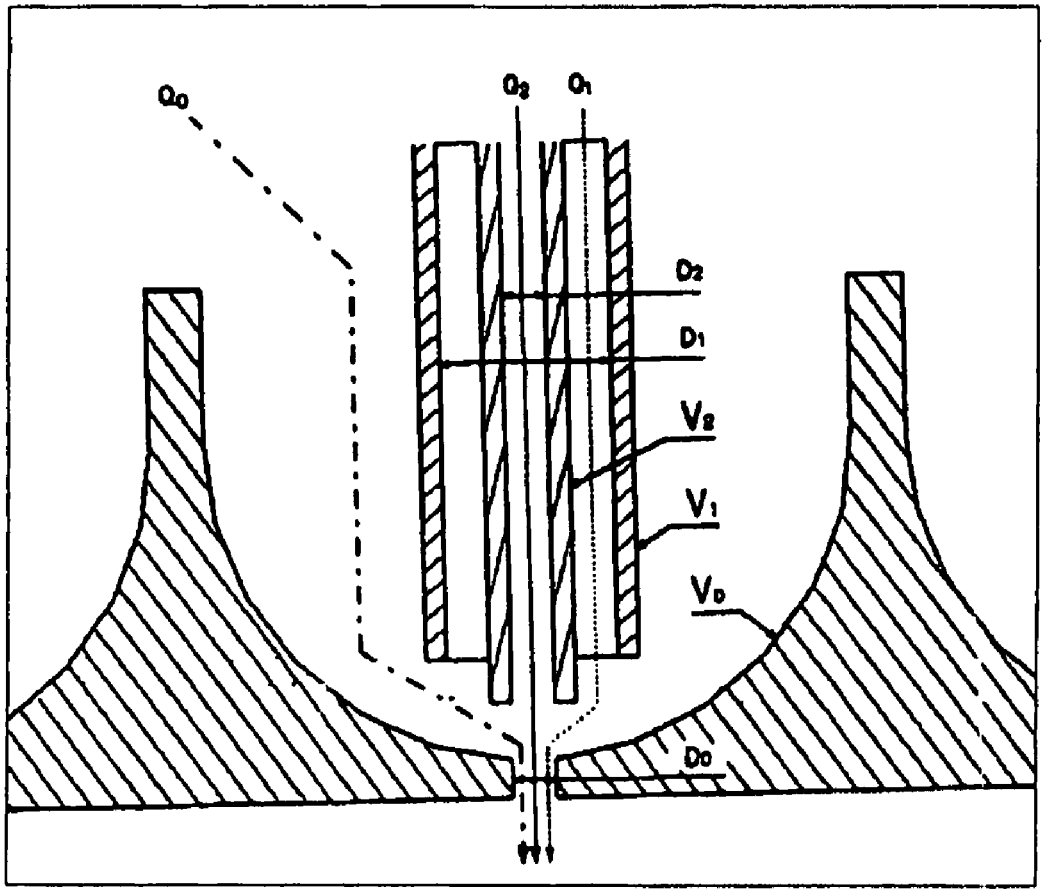
FIG. 2. Detail of an example of an embodiment of the invention in the case where N=2; two liquids 1 and 2 are forced (flow-rates $Q_1$ and $Q_2$), surrounded by a gas (flow-rate $Q_0$).
Figure 3A:
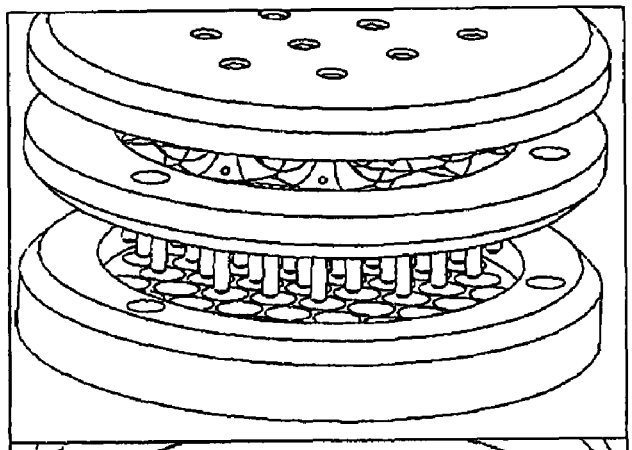
FIGS. 3A-3B. Two views of another embodiment of the device of the invention, pieced apart, showing details on the packaging of individual electrospray cells.
Figure 3B:
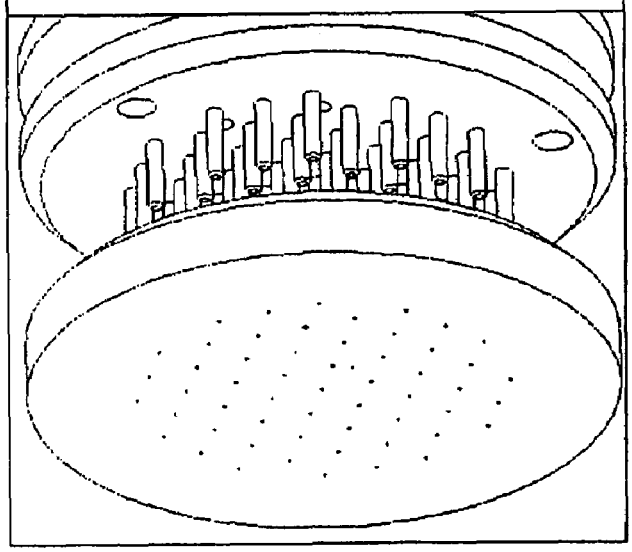
Figure 4:
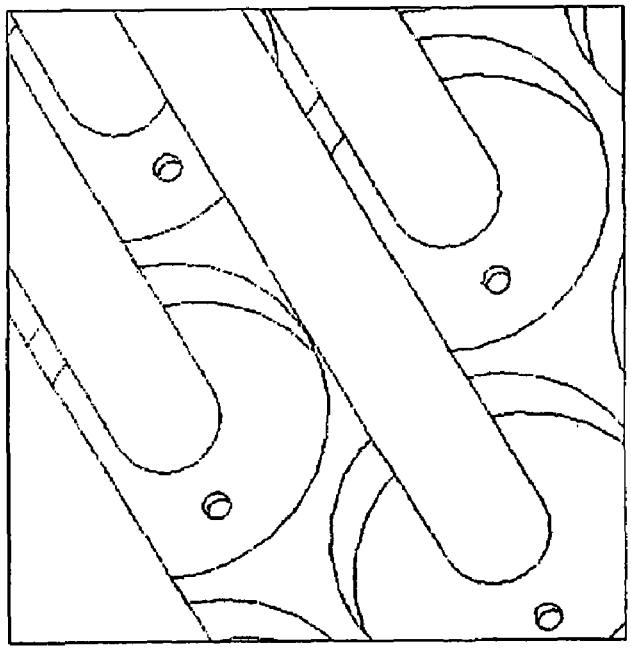
FIG. 4. Layout of the feed tubes in the electrodes, which surround the tip of the tubes forming a sheath.
Figure 5A:
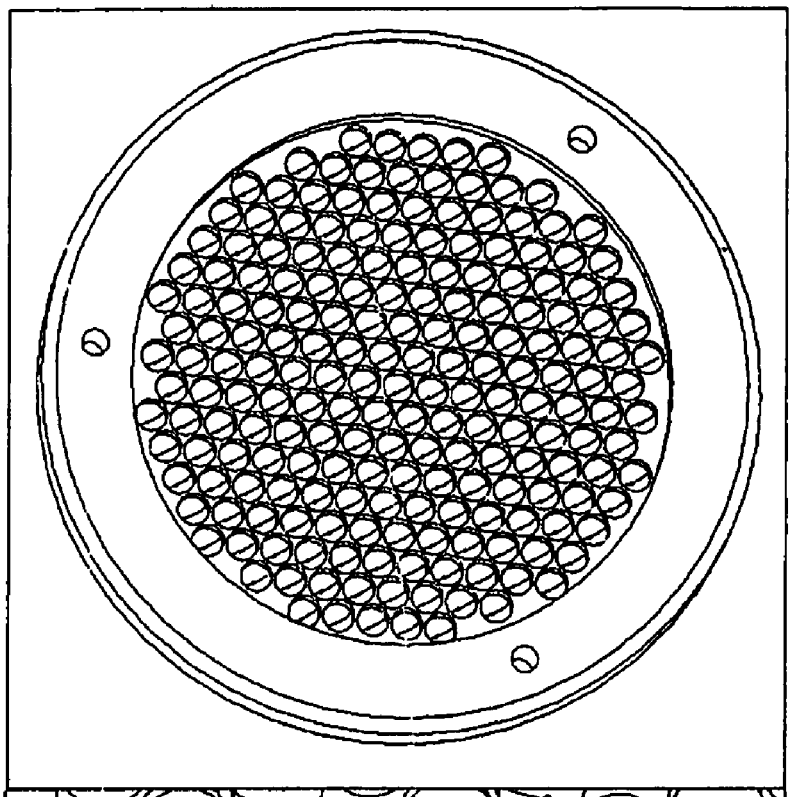
FIGS. 5A-5B. Details of a multi-electrode, showing again the high packaging density reached with this layout embodiment.
Figure 5B:
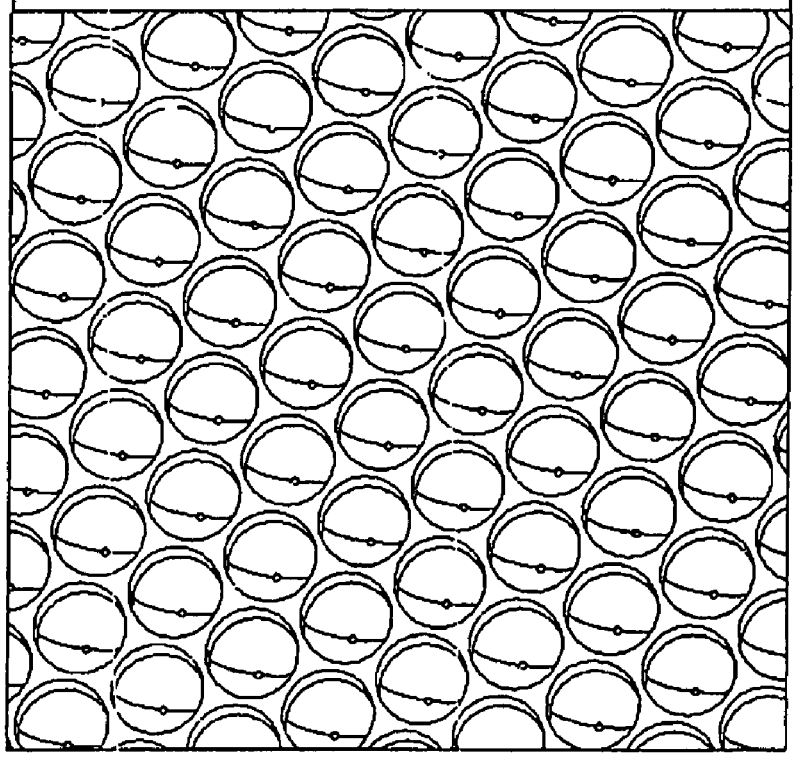
Figure 6A:
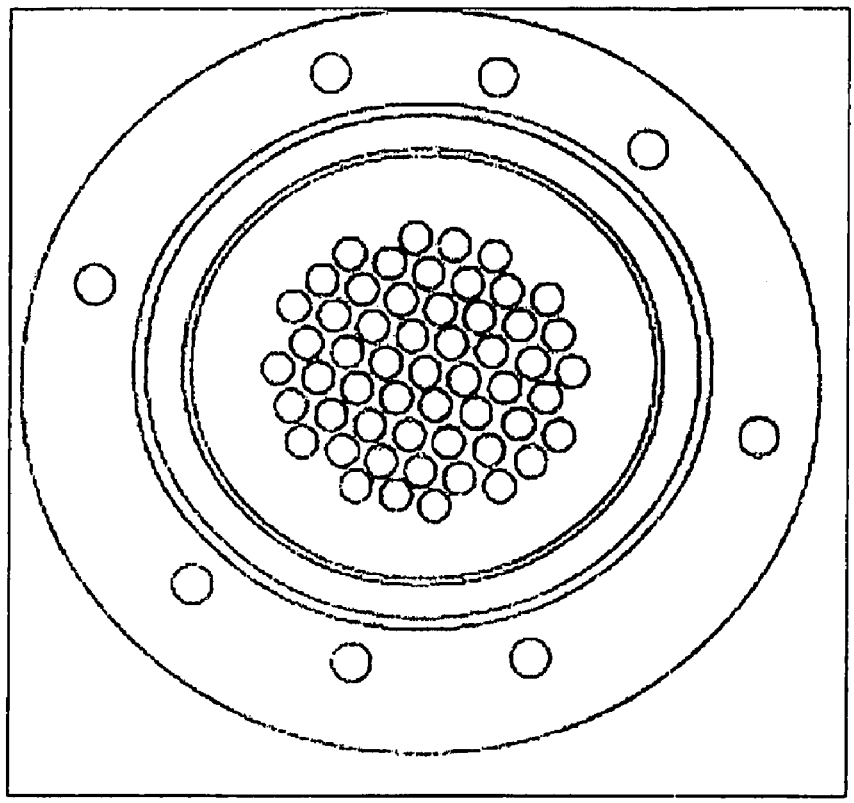
FIGS. 6A-6B. Upper and lower views of the 55-cells electrodes, built in AISI 316L stainless steel; individual focusing cells can be observed, as well as the micro-scale outlet orifices (diameter 200 micrometers).
Figure 6B:
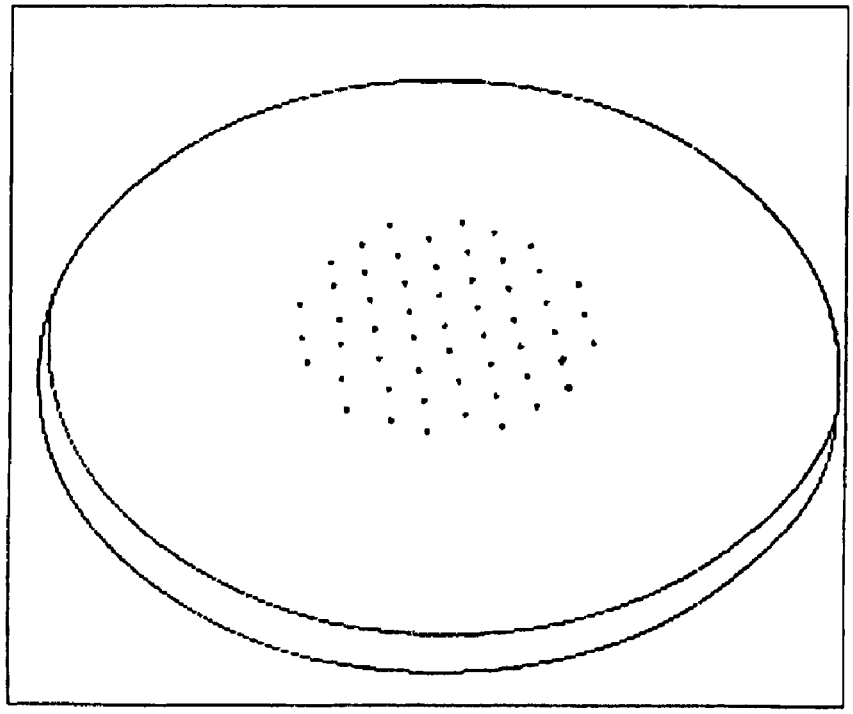
Figure 7:
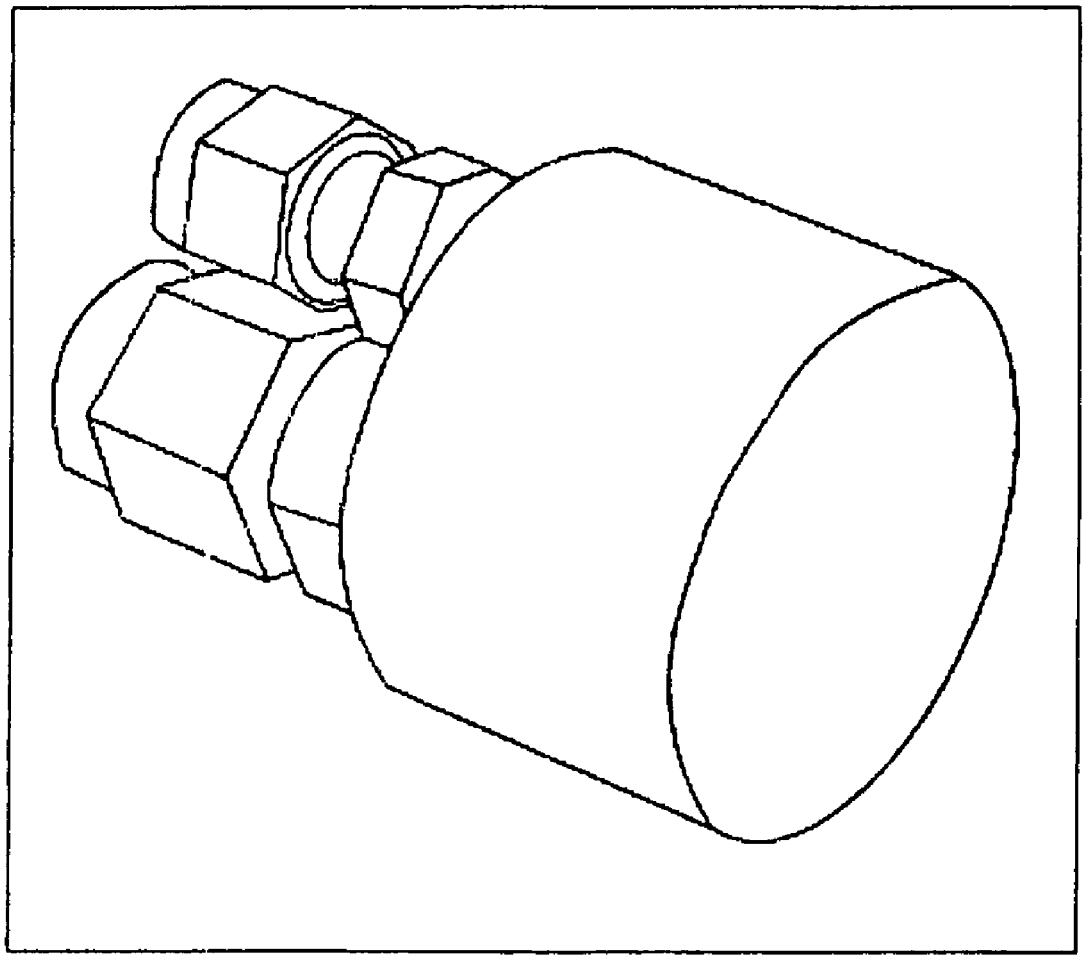
FIG. 7. A view of a device assembled by means of a thin film in Lockseal RTV Sylicone (0.1 mm thickness) used as an insulating device between the electrode and the remaining body of the device. Six Nylon screws (2 mm diameter) have been used as fastening means. Silica tubes (Polymicro, USA; 20 micrometers inner diameter and 365 micrometers outer diameter) have been used as feed tubes. The body of the device has been set at variable electric potential, and the outlet electrode is connected to the ground.

As shown in FIGS. 1 and 2, a device with 55 cells has been built, having a single feed tube per cell and thus transporting a single fluid; the material chosen was stainless steel AISI 316L. In order to shape the prototype, a PC-controlled CNC machining center has been used (EMCO PC Mill 155) as well as a precision lathe Pinacho. The electrode was fastened to the body of the device, which was built in AISI 316L stainless steel, with the help of six polyamide screws (Nylon) and a 0.1 mm thick Silicon RTV film, from Lockseal, meant to isolate the electrode from the body where the capillary tubes or feed tubes are set. The feed tubing is made in silica (Polymicro, USA) having an inner diameter of 20 micrometers and an outer diameter of 365 micrometers. The tubes are fastened to the body of the device by means of fitting holes. Aligning of the cell orifices with the feed tubes is ensured by means of alignment screws and a simple assembly procedure involving an external alignment tube. This allows to achieve small errors, inferior to 0.03 mm. The distance from the silica tubes and the inner wall of the electrode, where the outlet orifices are located, is fixed ta 350 micrometers. The voltage between the body of the device and the electrode ranges from 0 to 1000 Volts; distilled water is used as atomized fluid and air is used as forcing fluid. The feed pressures of air have ranged from 0 to 7 bars, but there is no restriction on this parameter other than the constraint set by the mechanical resistance of the plastic screws. The elements providing an inlet for water and air into the device have been made with Swagelok fittings, ⅛ and 1/16 inches respectively, made up of AISI 316 stainless steel; air and water tubing has been made with stainless steel tubes (AISI 304) with ⅛ and 1/16 inches respectively.

The invention claimed is:

1. A device used to produce steady capillary jets and liquid drops of at least one of micrometric and nanometric size, comprising:

a plurality of fluids;

a plurality of concentrically arranged capillary tubes, wherein each capillary tube of said plurality of concentrically arranged capillary tubes is surrounded by and transports a fluid i selected from the plurality of fluids and having a flow-rate $Q_i$, wherein i is an integer from 1 to N and N is equal to or greater than 1, wherein each said capillary tube of said plurality of concentrically arranged capillary tubes is connected to an electric potential $V_i$ with respect to a ground electrode; and wherein each fluid transported by a corresponding capillary tube is immiscible with an adjacent fluid transported by an adjacent capillary tube;

an electrode, connected to an electric potential $V_0$, facing an outlet of a first capillary tube selected from the plurality of concentrically arranged capillary tubes, said electrode includes an orifice having a minimal transversal dimension $D_0$ ranging from $10^{-6}$ to $10^2$ times a minimal transversal dimension $D_1$ of an outlet section of an outermost capillary tube of the plurality of concentrically arranged capillary tubes; said orifice is located facing an outlet of a second capillary tube selected from the plurality of concentrically arranged capillary tubes at a distance ranging from 0.005 to 5 times $D_1$; said electrode is shaped wherein each point of a surface of said electrode that is oriented toward said plurality of concentrically arranged capillary tubes is disposed a distance from the outer surface of the outermost capillary tube of the plurality of concentrically arranged capillary tubes, which is greater than a minimal distance from the orifice of said electrode to a capillary tube of the plurality of concentrically arranged capillary tubes having an outlet larger than outlets of all other capillary tubes of the plurality of concentrically arranged capillary tubes.

2. The device according to claim 1, wherein the orifice of the electrode and the outlets of said each capillary tube of the plurality of concentrically arranged capillary tubes are defined by a surface limited by a closed line having a geometry selected from one of a circular shape, a regular polygonal shape, an irregular polygonal shape, and an ellipsoidal shape.

3. The device according to claim 1, wherein the orifice of the electrode and the outlets of said each capillary tube of the plurality of concentrically arranged capillary tubes are defined by a surface limited by two closed curves having a geometry wherein a minimal distance between the two closed curves is smaller than 0.1 times a total length of a longer one of the two closed curves.

4. The device according to claim 1, wherein a potential difference $\Delta V$ between a potential of the outermost capillary tube ($V_1$) of the plurality of concentrically arranged capillary tubes and the potential of the electrode $V_0$ is larger than 0.1 times a greater of the two values $(\gamma.D_0/\epsilon_0)^{0.5}$ and $(\gamma.D_1/\epsilon_0)^{0.5}$, where $\gamma$ is an interfacial surface tension between the fluid flowing through an interior of the outermost capillary tube of the plurality of concentrically arranged capillary tubes and one of a fluid and a void located in a space between an outer wall of the outermost capillary tube of the plurality of concentrically arranged capillary tubes and an inner wall of the electrode, and $\epsilon_0$ is a permittivity of said one of the fluid and the void located in the space between the outer wall of the outermost capillary tube of the plurality of concentrically arranged capillary tubes and the inner wall of the electrode.

5. The device according to claim 1, wherein a the plurality of concentrically arranged capillary tubes are combined to define a single capillary tube, and the minimal transversal dimension $D_0$ of the orifice of the electrode ranges between $10^{-2}$ and 5 times the minimal transversal dimension $D_1$ of the outlet section of the single capillary tube, the orifice is located facing the outlet of the single capillary tube at a distance ranging between 0.05 and 2 times $D_1$, and each point of an inner surface of the electrode stands at a distance from the outer surface of the single capillary tube ranging from 1 to 10 times the minimal distance from the orifice of said electrode to the outlet of the single capillary tube, while an external edge of the electrode is located at a distance of 1 to 100 times $D_1$ from said orifice.

6. The device according to claim 1, wherein $D_1$ ranges from 0.5 micrometers and 5 milimeters.

7. The device according to claim 1 wherein an outer surface of at least one capillary tube of the plurality of concentrically arranged capillary tubes is covered by a hydrophobe substance.

8. Multi-device for the production of steady capillary jets and liquid drops of at least one of micrometric and nanometric size, comprising:

at least three devices according to claim 1, assembled in the vicinity of each other, and with relative angles ranging from −89 to 89 sexagesimal degrees, all of said devices pointing in a same direction, wherein axes of said each capillary tube of the plurality of concentrically arranged capillary tubes form a minimal angle from 5 to 90 sexagesimal degrees relative to one of a plane and a virtual surface where the orifices of said electrode and said ground electrodes are located.

9. A method for producing steady capillary jets and liquid drops of at least one of micrometric and nanometric size using the device according to claim 1, comprising the following steps:

a) forcing at least one fluid of the plurality of fluids to flow through a corresponding number of capillary tubes of the plurality of concentrically arranged capillary tubes; and b) connecting the electrode, to an electric potential $V_0$, wherein a potential difference $\Delta V$ between a potential of the outermost capillary tube ($V_1$) of the plurality of concentrically arranged capillary tubes and the potential of the electrode $V_0$ is larger than 0.1 times a greater of the two values $(\gamma.D_0/\epsilon_0)^{0.5}$ and $(\gamma.D_1/\epsilon_0)^{0.5}$, where $\gamma$ is an interfacial surface tension between the fluid flowing through an interior of the outermost capillary tube of the plurality of concentrically arranged capillary tubes and one of a fluid and a void located in a space between an outer wall of the outermost capillary tube of the plurality of concentrically arranged capillary tubes and an inner wall of the electrode, and $\epsilon_0$ is a permittivity of said one of the fluid and the void located in the space between the outer wall of the outermost capillary tube of the plurality of concentrically arranged capillary tubes and the inner wall of the electrode.

10. A method for producing steady capillary jets and liquid drops of at least one of micrometric and nanometric size using the device according to claim 7, comprising the following steps of:

connecting the outermost capillary tube of the plurality of concentrically arranged capillary tubes at a potential $V_1$ and connecting the electrode at the potential $V_0$; and forcing at least one fluid of the plurality of fluids to flow between the outer surface of the electrode and an inner surface of the outermost capillary tube of the plurality of concentrically arranged capillary tubes towards the orifice of the electrode, wherein said at least one fluid of the plurality of fluids is immiscible with an adjacent fluid forced through the outermost capillary tube of the plurality of concentrically arranged capillary tubes, and wherein a flow-rate of said at least one fluid is $Q_0$, where $Q_0$ is larger than 0.1 times a greater value of $D_0^2[\gamma/(D_0.\rho_0)]^{0.5}$ and $D_1^2[\gamma/(D_1.\rho_0)]^{0.5}$, where $\rho_0$ is a density of said at least one fluid, and $\gamma$ is an interfacial surface tension between the adjacent fluid flowing through the outermost capillary tube of the plurality of concentrically arranged capillary tubes and the at least one fluid forced through a space between the outer wall of the outermost capillary of the plurality of concentrically arranged capillary tubes and the inner wall of the electrode.

11. A method for producing bubbles of at least one of micrometric and nanometric size using the device according to claim 1, comprising the following steps:

a) forcing at least one fluid of the plurality of fluids to flow through a corresponding number of capillary tubes; and b) connecting the electrode to an electric potential $V_0$, wherein a potential difference $\Delta V$ between a potential of the outermost capillary tube ($V_1$) of the plurality of concentrically arranged capillary tubes and the potential of the electrode $V_0$ is larger than 0.1 times a greater of the two values $(\gamma.D_0/\epsilon_0)^{0.5}$, and $(\gamma.D_1/\epsilon_0)^{0.5}$, where $\gamma$ is an interfacial surface tension between the fluid flowing through an interior of the outermost capillary tube of the plurality of concentrically arranged capillary tubes and one of a fluid and a void located in a space between an outer wall of the outermost capillary tube of the plurality of concentrically arranged capillary tubes and an inner wall of the electrode, and $\epsilon_0$ is a permittivity of said one of the fluid and the void located in the space between the outer wall of the outermost capillary tube of the plurality of concentrically arranged capillary tubes and the inner wall of the electrode, wherein the fluid forced through an innermost capillary tube of the plurality of concentrically arranged capillary tubes is a gas.

12. The method according to claim 9, comprising the additional step of:

forcing the at least one fluid to flow between the outer surface of the electrode and the inner surface of the outermost capillary tube of the plurality of concentrically arranged capillary tubes towards the orifice of the electrode, wherein said at least one fluid is immiscible with the fluid forced through the outermost capillary tube, wherein the flow-rate of said at least one fluid is $Q_0$, where $Q_0$ is larger than 0.1 times a greater value of $D_0^2\ [\gamma/(D_0.\rho_0)]^{0.5}$ and $D_1^2\ [\gamma/(D_1.\rho_0)]^{0.5}$, where $\rho_0$ is a density of said at least one fluid.

* * * * *